US006799692B2

(12) United States Patent
Teixeira Alvares et al.

(10) Patent No.: US 6,799,692 B2
(45) Date of Patent: Oct. 5, 2004

(54) CAN LID

(75) Inventors: Antonio Carlos Teixeira Alvares, São Paulo (BR); Antônio Roberto Sene, São Paulo (BR)

(73) Assignee: Brasilata S.A. Embalagens Metalicas, Sao Paulo (BR)

( * ) Notice: Subject to any disclaimer, the term of this patent is extended or adjusted under 35 U.S.C. 154(b) by 52 days.

(21) Appl. No.: 10/221,420

(22) PCT Filed: Jun. 20, 2001

(86) PCT No.: PCT/BR01/00078

§ 371 (c)(1),
(2), (4) Date: Oct. 22, 2002

(87) PCT Pub. No.: WO01/98165

PCT Pub. Date: Dec. 27, 2001

(65) Prior Publication Data

US 2003/0089715 A1 May 15, 2003

(30) Foreign Application Priority Data

Jun. 20, 2000 (BR) ..... 0003727

(51) Int. Cl.[7] ..... B65D 25/32; B65D 45/04; B65D 45/32

(52) U.S. Cl. ..... 220/254.1; 220/318; 220/319; 220/756; 220/763

(58) Field of Search ..... 220/254.1, 265, 220/266, 269, 270, 318, 319, 756, 763, 762, 771–774, 769

(56) References Cited

U.S. PATENT DOCUMENTS

| | | | | | |
|---|---|---|---|---|---|
| 3,949,663 | A | * | 4/1976 | Eckerle | 100/229 A |
| 4,380,304 | A | * | 4/1983 | Anderson | 220/782 |
| 4,386,715 | A | * | 6/1983 | Morton | 220/798 |
| 4,998,622 | A | * | 3/1991 | Drack | 206/519 |
| 5,027,973 | A | * | 7/1991 | Drogos | 220/657 |
| 5,520,306 | A | * | 5/1996 | Umiker | 220/754 |
| 5,842,593 | A | | 12/1998 | von Holdt | |
| 5,899,352 | A | | 5/1999 | Guarda et al. | |

FOREIGN PATENT DOCUMENTS

| | | |
|---|---|---|
| EP | 0 365 823 | 5/1990 |

* cited by examiner

*Primary Examiner*—Stephen K. Cronln
*Assistant Examiner*—Niki M. Eloshway
(74) *Attorney, Agent, or Firm*—Darby & Darby

(57) ABSTRACT

A lid for a can comprising a tubular body (10) with an upper end affixing an annular upper wall (20), which internally defines a seat (21) for the hermetic seating of the lid (30), said lid comprising, in a single piece: a sealing portion (31), which is removably seated and retained in the seat (21) and provided with an upper edge (33); and a pair of handles (35) disposed around at least part of the upper edge (33) and having ends unremovably incorporated thereto at points angularly spaced from each other, said handles (35) being medianly displaceable from an inoperative position, substantially coplanar to said upper edge (33), to a raised operative position, after the breakable means (36) have been broken. The present lid may further comprise a seal strip (40) peripherally incorporated to the pair of handles (35).

8 Claims, 4 Drawing Sheets

CAN LID

FIELD OF THE INVENTION

The present invention refers to a lid for closing a can obtained in a metallic sheet and of the type comprising a tubular body, with its lower edge affixing or incorporating a bottom wall and with its upper edge affixing an annular upper wall portion, which can take the form of a structural ring and which inner peripheral edge defines a seat for seating and retaining the press fittable lid. Particularly, the invention refers to the provision of a lid for a can of the type considered above and used for containing products of progressive consumption, such as certain foods.

BACKGROUND OF THE INVENTION

Determined products, such as certain foods, have to be submitted to hermetic storage and provided with a clear visual indication to the consumer that the container in which they are presented to the market has not been violated. It should also be considered that, since many of these products are of progressive consumption, it is indispensable that after the first opening of the container, the lid, which gives access to the inside of the can, may be reclosed as many times as necessary during the progressive consumption of the stored product, in order to guarantee the hermeticity of the reclosed can and protect the remaining content thereof.

There are well known in the art the cans, in which the lid is press fitted in a peripheral structural ring, which is internal to the upper edge of the can body and which is hermetically double seamed thereto. The hermeticity of the content is guaranteed, in this type of construction, by fitting the lid in the seat designed for seating and retaining the lid, said seat being provided in the structural ring that defines the annular upper wall of the can.

In this type of closure, the tamper evident seal, which also guarantees the hermeticity, is usually defined by an aluminum metallic sheet, which is peripherally double seamed to the upper edge of the can body, together with the structural ring. This inner seal is only visible when the lid is removed and requires the use of an instrument for cutting it peripherally, which operation invariably leaves cutting edges close to the upper opening of the can, often causing accidents and hurting the user's fingers.

Besides the inconveniences mentioned above, these known press fitted lids require the use of an instrument, in the form of a lever, for helping the user to remove the lid from its seat defined in the structural ring. It is not possible for the user to remove this type of lid only with his hands.

SUMMARY OF THE INVENTION

It is a generic object of the present invention to provide a reclosable lid for the can of the type considered herein, which presents a simple construction and reduced cost, incorporating means for facilitating the opening thereof and also, preferably, a seal of prompt visual indication of violation. A further object of the present invention is to provide a lid, as defined above, which may be safely and easily handled by the consumer.

These and other objects and advantages of the present invention are achieved by providing a lid for a can of the type comprising a tubular body, with an upper end affixing, by double seaming, an annular upper wall, which internally defines a seat for the hermetic seating of the lid.

According to the invention, the lid comprises, in a single piece: a sealing portion, which is removably seated and retained in the seat and provided with an upper edge; and a pair of handles disposed around at least part of the upper edge and having unremovable ends incorporated thereto, at points angularly spaced from each other, said handles being medianly displaceable, by deformation of its end portions, from an inoperative position, which is substantially coplanar to said upper edge and in which they are kept, until the first opening of the lid, medianly incorporated to the sealing portion by respective breakable means, to a raised operative position, after the breakable means have been broken.

The lid may further comprise, preferably in a single piece, a manually removable seal strip, provided around the upper end of the tubular body and presenting a lower portion, which is seated and locked under the double seam of the annular upper wall, and an upper portion, which retains the handles in the inoperative condition.

BRIEF DESCRIPTION OF THE DRAWINGS

The invention will be described below, with reference to the appended drawings, in which.

DESCRIPTION OF THE ILLUSTRATED EMBODIMENT

According to the appended drawings, the present lid is applied to a can made of a metallic sheet and comprising a tubular body 10, with a lower end affixing a bottom wall, not illustrated, and with an upper end affixing, by double seaming, an annular upper wall 20, which internally defines a seat 21 for the hermetic seating of the lid 30.

Figure 1:
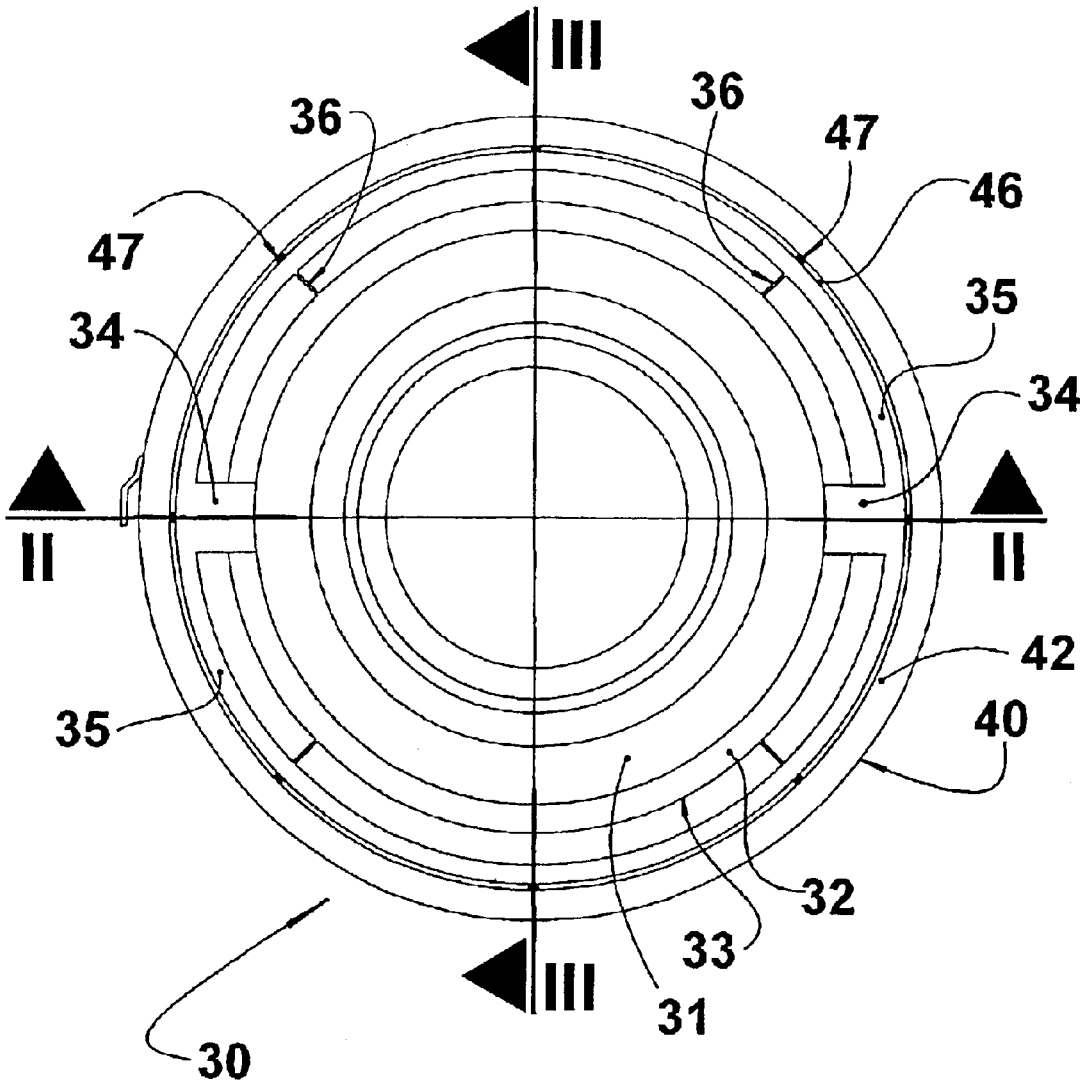
FIG. 1 represents a top plan view of a lid constructed according to the present invention, incorporating the seal strip and having the handles maintained in the inoperative position.
Figure 2:
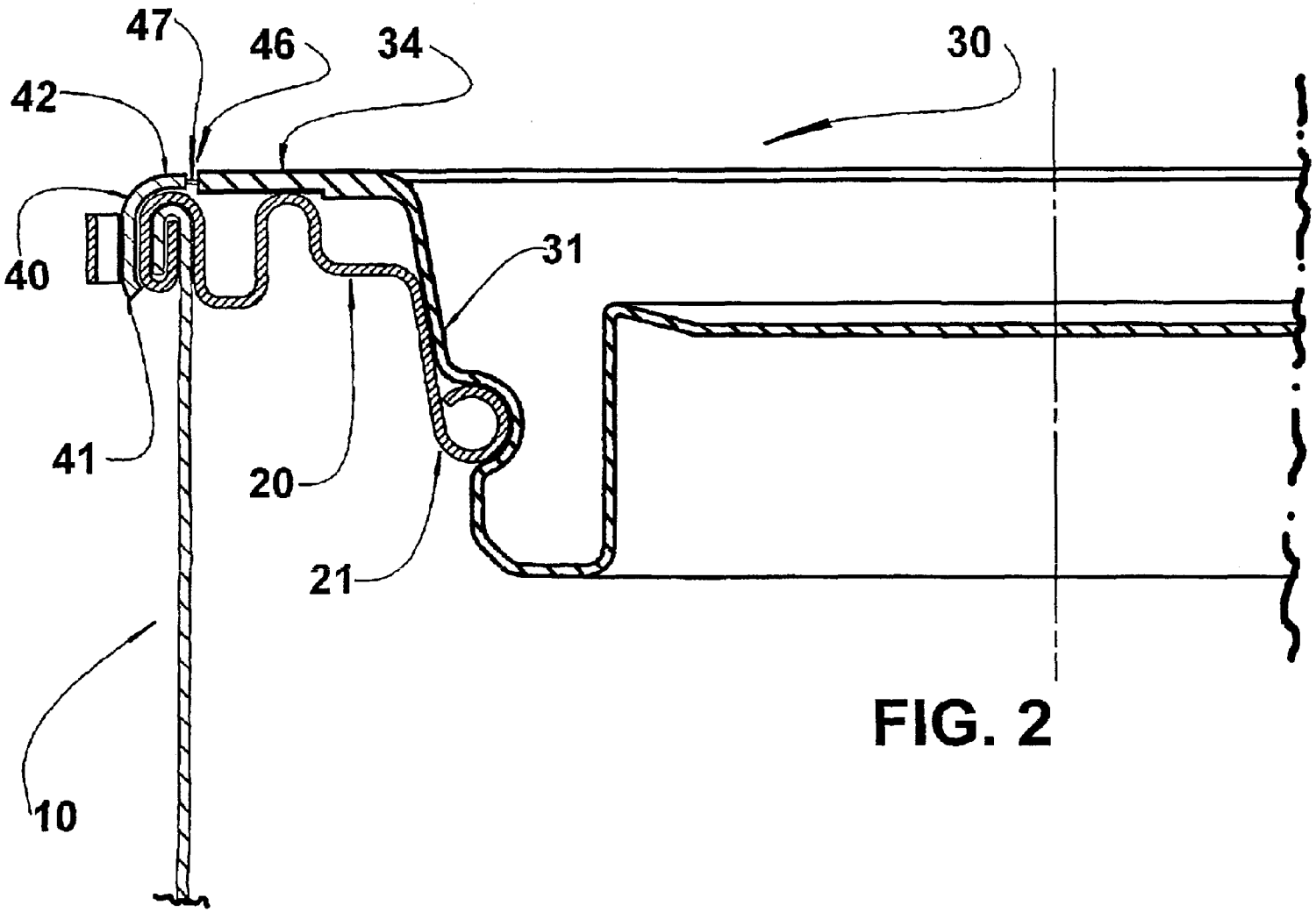
FIG. 2 represents a partial diametrical cross-sectional view of the lid illustrated in FIG. 1 and mounted in the upper end of a can, said cross-section being taken according to line II—II of FIG. 1.
Figure 3:
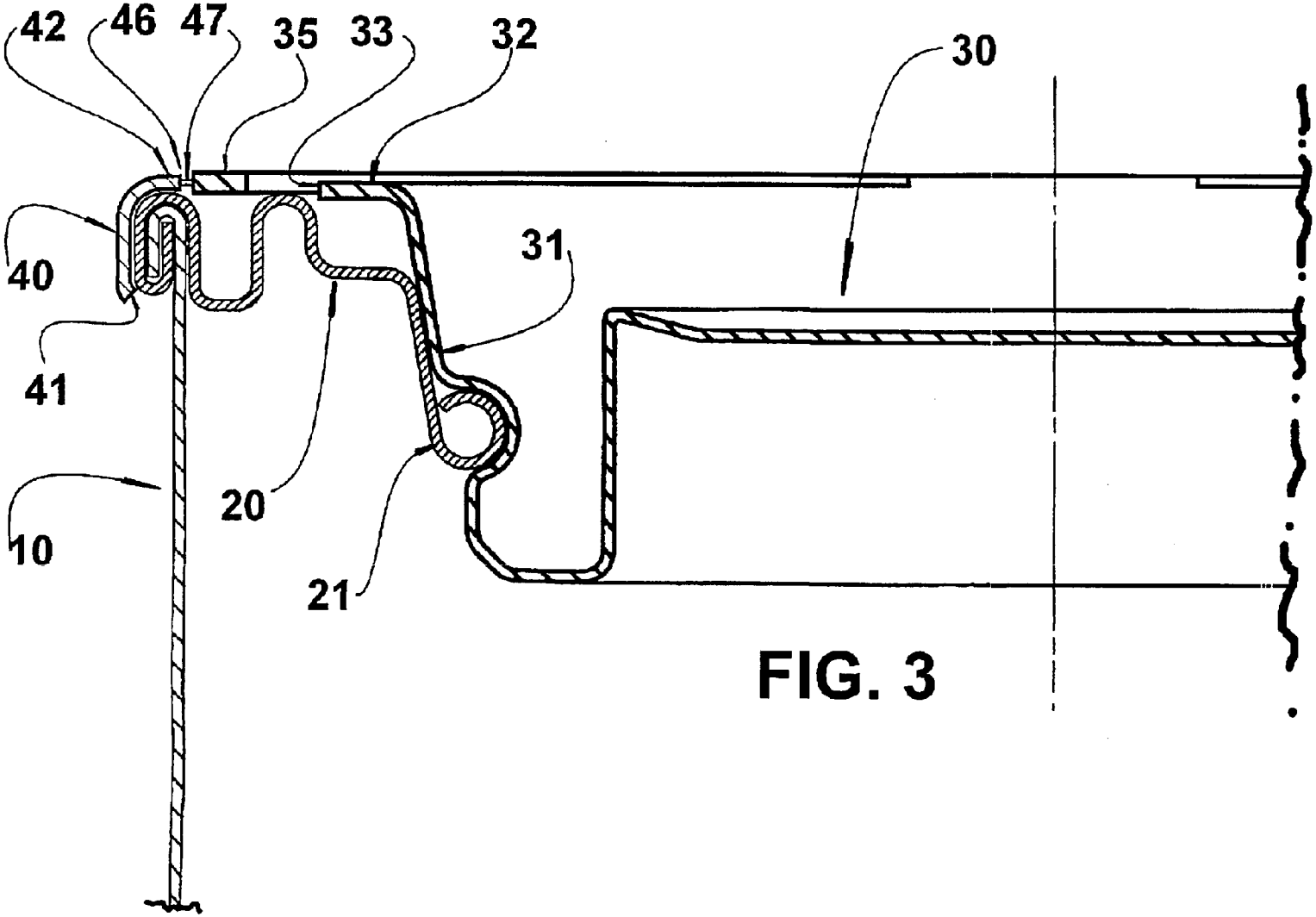
FIG. 3 represents a similar view to that in FIG. 2, but illustrating the cross-section taken according to line III—III of FIG. 1.
Figure 4:
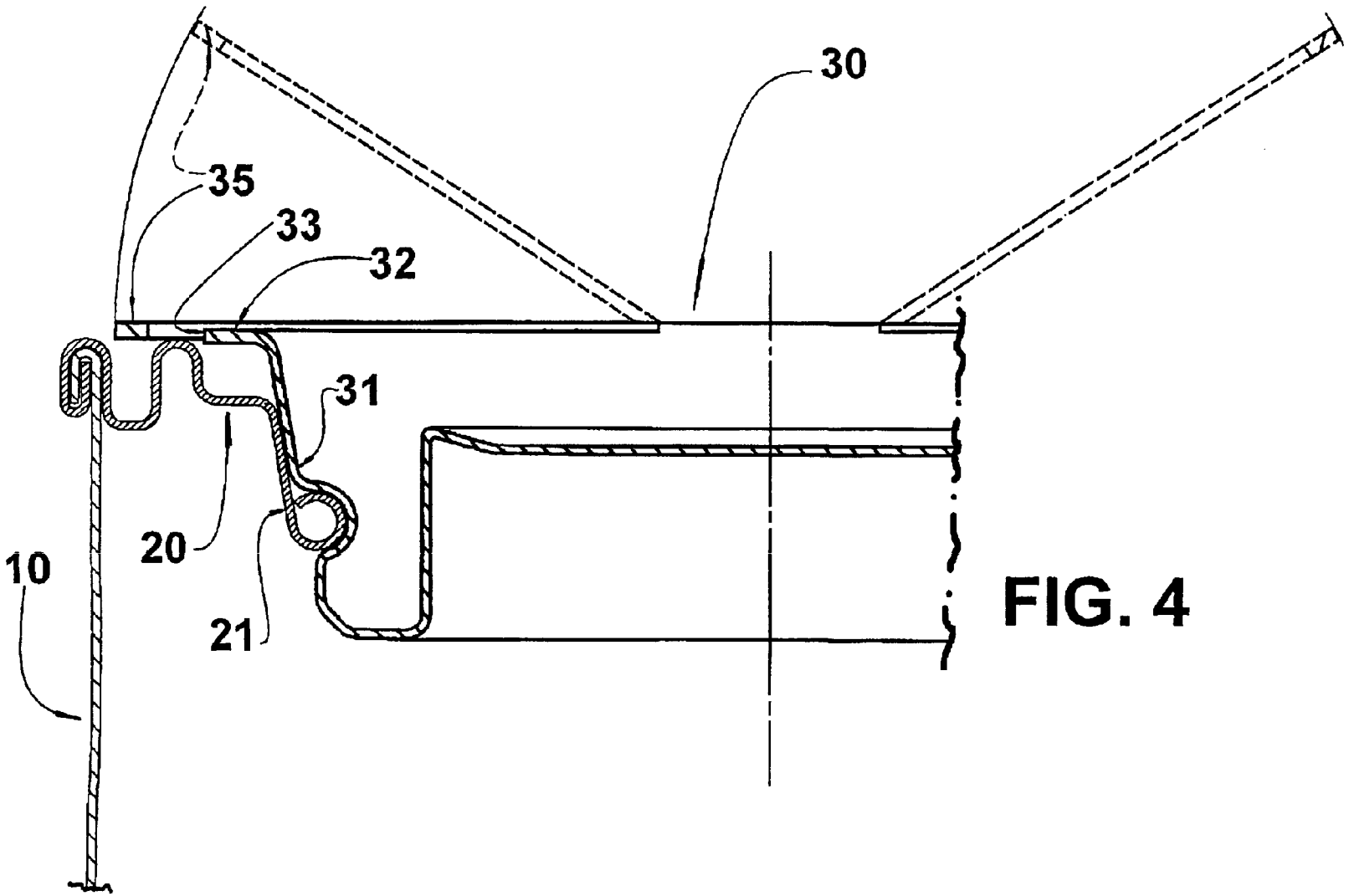
FIG. 4 represents a similar view to that of FIG. 3, but illustrating the can-lid assembly after the removal of the strip seal and also illustrating, in dashed lines, the handles in a partially upwardly displaced position.

The annular upper wall 20 can take the form of a structural ring, as illustrated in FIGS. 2, 3 and 4, or even in the form of an annular plate in the cans with great dimensions, such as the 18-liter cans.

The construction of the annular upper wall 20 and the seat 21 may be achieved by different manners, provided that it allows a safe and hermetic fitting of the lid 30 to the upper part of the can. In FIGS. 2, 3 and 4, the construction of the annular upper wall 20 and of the seat 21 is accomplished as described and claimed in a patent issued to the same applicant in Brazil (BR PI9408643-5) and in other countries (U.S. Pat. No. 5,899,352; EP 0 706 486), and which is not going to be described in details in the present disclosure.

According to the invention and as illustrated in the appended drawings, the lid 30 is preferably constructed in plastic material, transparent or not, comprising a sealing portion 31 of adequate construction, to be removably seated and retained in the seat 21, said sealing portion presenting an upper edge 33 which, in the illustrated embodiment, is defined by an outer peripheral flange 32, superiorly incorporated to the sealing portion 31. The lid 30 further comprises, in a single piece with the sealing portion 31, a pair of handles 35 disposed around at least part of the upper edge 33 and having the ends unremovably incorporated thereto at points angularly spaced from each other. In the illustrative embodiment, the two handles 35 have a semi-annular shape, with the ends thereof incorporated to the upper edge 33 of the sealing portion 31 at opposite points of the latter.

If we consider the usual circular contour of this type of lid, we will have a construction in which the handles 35 present a semi-circular annular shape, each handle surrounding, with a certain radial spacing, a respective half of the contour of the upper edge 33 of the sealing portion 31. The handles 35 have the ends thereof preferably incorporated to two opposite external radial projections 34 of the upper edge 33 of the sealing portion 31, facilitating the construction of the pair of handles slightly spaced from the upper edge 33.

This constructive arrangement allows obtaining a pair of handles formed in a single piece with the sealing portion 31, said handles 35 being medianly incorporated to the sealing portion 31 by respective breakable means 36, which in the preferred illustrated embodiment take the form of small radial bridges, medianly interconnecting the handles 35 to said upper edge 33 of the sealing portion 31.

Providing the handles 35 as described above allows, upon the first opening of the lid, the handles 35 to be manually medianly forced up, in order to cause rupture of the respective breakable means 36, so that these handles may be subsequently medianly displaced, by deformation of the end portions thereof, from an inoperative position, substantially coplanar to said upper edge 33, to a raised operative position, illustrated in FIG. 4 and in which they constitute a gripping means for the user, who pulls the lid out from its seat 21, allowing the can to be easily opened, without requiring auxiliary instruments.

Still according to the illustrations of the appended drawings, aiming at guaranteeing the inviolability of the can until the occurrence of its first opening, the present lid further comprises a manually removable annular strip 40, disposed around the upper end of the tubular body 10 and presenting a lower portion 42, which is seated and locked under the double seam of the annular upper wall 20, and an upper portion 41, which is designed to retain the handles 35 in the inoperative condition.

In the preferred illustrated embodiment, the annular strip 40 is formed in a single piece with the handles 35 and the sealing portion 31, the upper portion 42 of the seal strip being incorporated to the handles 35, by means of a connecting portion 46, which is broken when the seal strip 40 is removed. This connecting portion 46 may comprise, for instance, a plurality of small radial rods 47 interconnecting the upper portion 42 of the seal strip 40 to the handles 35.

According to the arrangement described above, in order to open the can by removing the lid 30, the user has to detach the seal strip 40, forcing it to separate from the remaining of the lid, by breaking the small radial rods 47. After removing the seal strip 40, the user may medianly and manually force the two handles up, causing rupture of the breakable means 36, and then take the pair of handles to a raised position, in which the handles are medianly adjacent, defining a comfortable gripping means for allowing the user to axially pull the lid from its seat 21 and to open the can without using any additional tool. This construction further allows the lid 30 to be reconducted to its closing position, in order to maintain the hermeticity inside the can, protecting the remaining of the product for future use.

What is claimed is:

1. A lid for a can comprising a tubular body, with an upper end affixing, by double seaming, an annular upper wall, which internally defines a seat for the hermetic seating of the lid, wherein the lid comprises, in a single piece:

a sealing portion, which is removably seated and retained in the seat and which is provided with an upper edge;

a pair of handles disposed around at least part of the upper edge and having ends unremovably incorporated thereto, at points angularly spaced from each other, said handles being medianly displaceable by deformation of their end portions, from an inoperative position, substantially coplanar to said upper edge and in which they are kept, until the first opening of the lid, medianly incorporated to the sealing portion by respective breakable means, to a raised operative position, after the breakable means have been broken;

a manually removable seal strip, disposed around the upper end of the tubular body and presenting a lower portion, which is seated and locked under the double seam of the annular upper wall; and an upper portion retaining the handles in the inoperative condition.

2. The can lid of claim 1, wherein the handles are semi-annular, having the ends incorporated to the upper edge of the sealing portion at opposite points of the latter.

3. The can lid of claim 1, wherein the breakable means are defined by a plurality of small radial bridges medianly interconnecting the handles to said upper edge.

4. The can lid of claim 3, wherein the handles have the opposite ends thereof incorporated to two opposite external radial projections of the upper edge of the sealing portion.

5. The can lid of claim 1, wherein the upper edge is defined by an external peripheral flange incorporated to the sealing portion and designed to be seated on the annular upper wall.

6. The can lid of claim 1, wherein the seal strip is formed in a single piece with the handles and the sealing portion, the upper portion of the seal strip being incorporated to the handles by means of a connecting portion, which is broken upon removal of the seal strip.

7. The can lid of claim 6, wherein the connecting portion comprises a plurality of small radial rods interconnecting the upper portion of the seal strip to the handles.

8. The can lid of claim 6, wherein the upper portion of the seal strip is seated on the upper end of the tubular body.

* * * * *